United States Patent [19]

Imada

[11] 4,194,436

[45] Mar. 25, 1980

[54] SPEEDUP DEVICE FOR RECIPROCATING CYLINDERS

[75] Inventor: Yusuke Imada, Itami, Japan

[73] Assignee: Sanyo Kiki Kabushiki Kaisha, Kyogo, Japan

[21] Appl. No.: 804,846

[22] Filed: Jun. 8, 1977

[30] Foreign Application Priority Data

Jun. 10, 1976 [JP] Japan ..... 51-75993

[51] Int. Cl.[2] ..... F15B 13/042

[52] U.S. Cl. ..... 91/420; 91/436

[58] Field of Search ..... 91/436, 420

[56] References Cited

U.S. PATENT DOCUMENTS

| | | | |
|---|---|---|---|
| 1,812,587 | 6/1931 | Ellis | 91/420 X |
| 2,890,683 | 6/1959 | Pilch | 91/420 |
| 3,497,032 | 2/1970 | Schott | 91/436 X |
| 3,654,835 | 4/1972 | Sievenpiper | 91/436 |

FOREIGN PATENT DOCUMENTS

| | | | |
|---|---|---|---|
| 863701 | 3/1961 | United Kingdom | 91/436 |
| 141046 | 1/1960 | U.S.S.R. | 91/436 |

*Primary Examiner*—Irwin C. Cohen

*Attorney, Agent, or Firm*—Armstrong, Nikaido, Marmelstein & Kubovcik

[57] ABSTRACT

A speedup device for reciprocating cylinders which make use of fluid pressure such as hydraulic pressure or pneumatic pressure. The speedup device incorporates a poppet valve adapted to be moved for valving upon application of fluid pressure and is installed in a pipe line connecting a control valve to the front and rear chambers of a cylinder, the arrangement being such that when the rod of the reciprocating cylinder is to be extended, all the return from the front cylinder chamber flows into the rear chamber, thereby speeding up the extension of the rod of the reciprocating cylinder.

1 Claim, 12 Drawing Figures

SPEEDUP DEVICE FOR RECIPROCATING CYLINDERS

BACKGROUND OF INVENTION

1. Field of the Invention

The present invention relates to a speedup device for reciprocating cylinders which make use of hydraulic or pneumatic pressure which are of wide application, and more particularly, it relates to a device for speeding up the extension of the rod of such reciprocating cylinder.

While there are many machines in which the speedup of the extension of the rod of a reciprocating cylinder is required, the invention is applied to the front loader of a transport and loading machine to speed up the extension of the rod of a cylinder, and hence the discharge rotation of the bucket of the front loader, thereby improving the efficiency of operation.

2. Description of the Prior Art

In the case of a machine in which a bucket pivoted to the front end of an arm is rotated to scoop earth, sand or other load and discharge it, a mere switching of a fixed amount of oil between the front and rear chambers of the cylinder results in different rates of extension and retraction of the piston rod.

This is due to the different volumes of the front and rear chambers of a reciprocating cylinder. More particularly, the volume of the front chamber where the piston rod exists is smaller than the volume of the rear chamber by an amount corresponding to the volume of the piston rod. As a result, when a case where a fixed amount of oil is fed into the rear chamber to extend the piston rod is compared with a case where the same amount of oil is fed into the rear chamber to retract the piston rod, it is seen that the rate of movement of the piston rod is higher in the latter case than in the former case. Therefore in the case of this machine, the rotative speed of the bucket is high when scooping earth, sand or other load but low when discharging it. With this, the efficiency of operation cannot be improved.

In machines, including those using hydraulic cylinders, much time and money has been involved in improving the efficiency of operation. This is because the measures taken have been to increase the size and capacity of hydraulic pumps and electric motors so as to increase the rate of extension of the reciprocating cylinder rod. Accordingly, there has been a disadvantage that these measures make it necessary to increase the size of the pipe line and additionally install a link system, thereby further increasing the cost.

As a recent measure to eliminate these drawbacks, there has been known what is called a boost valve (refer to the June, 1976 issue of the magazine "Yuatsuka Sekkei" (Hydraulic Design).) It includes three check valves which are arranged in parallel so that oil may flow in predetermined directions and part of the return oil from the front chamber of the cylinder may join oil from a pump in front of a control valve, thereby increasing the rate of extension of the cylinder rod. Therefore, this arrangement makes it necessary to increase the size of control valves and pipes.

SUMMARY OF THE INVENTION

The present invention is intended to eliminate the drawbacks inherent in reciprocating cylinders and provide a device for increasing the rate of extension of the rod of a reciprocating cylinder in order to improve the efficiency of operation of machines using reciprocating cylinders.

To this end, the invention provides a speedup device designed to cause all the return oil from the front chamber of a reciprocating cylinder to flow into the rear chamber of the cylinder at the time of extending the rod of the cylinder. This speedup device comprises one or two poppets adapted to be moved for valving in connection with application of hydraulic pressure and installed in a pipe line between a control valve and the front and rear chambers of a reciprocating cylinder.

According to the invention, the rate of oil feed to the rear chamber of a cylinder is increased, thereby increasing the rate of extension of the rod. Further, the following structural merits can be obtained: Since one or two poppet valves are used to cause the return oil from the front chamber to flow into the rear chamber without passing through the control valve, the device can be compactly assembled to the cylinder without involving the increase of the size of the control valve and pipe line. Thus, the arrangement is simple, free from troubles, and inexpensive. It is possible to attach the device to existing reciprocating cylinders without substantial remodeling. Further, by selecting suitable piston rod diameters, it is possible to adjust the rate of extension of the rod of the reciprocating cylinder without using a special direction control valve or the like.

When the invention is applied to the reciprocating cylinder for the front loader of a transport and loading machine, the rate of extension of the rod and hence the discharge rotative speed of the bucket is increased, so that the effect of slinging earth, sand or other load is improved, minimizing the possibility of such load sticking to the bucket. Additionally, since the efficiency of operation is increased, the operating hours of the machine can be shortened, saving fuel cost. It is clear that the speedup device of the invention is applicable not only to reciprocating cylinders using hydraulic pressure but also to cylinders using pneumatic pressure. Thus, the range of applications of the invention is very wide.

These and other structural features of the invention will be described in more detail with reference to the accompanying drawings.

DESCRIPTION OF THE PREFERRED EMBODIMENTS

Figure 1A:
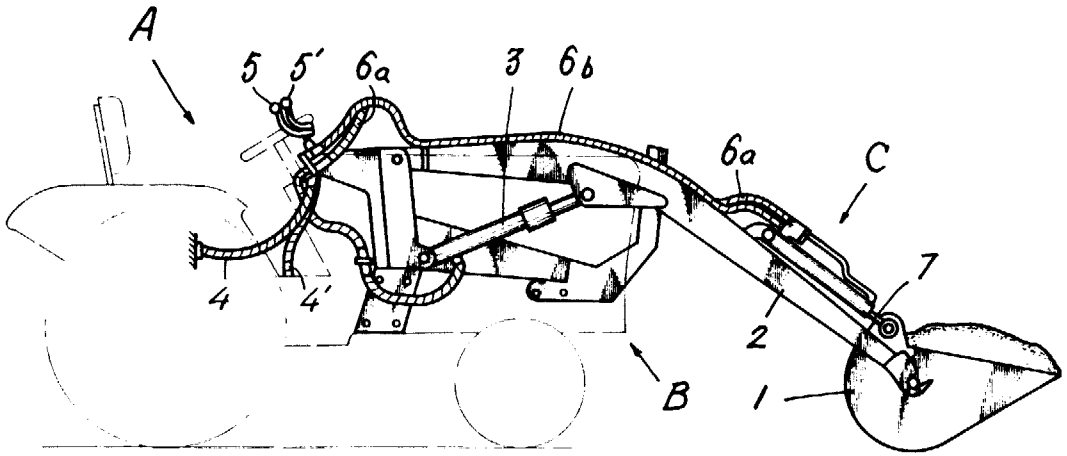
FIG. 1*a* is a side view of a tractor equipped with a front loader.

In FIG. 1*a*, A designates a tractor; B, a front loader attached to the tractor A; and C designates a reciprocating hydraulic cylinder equipped with a speedup device according to the present invention.

Figure 1B:
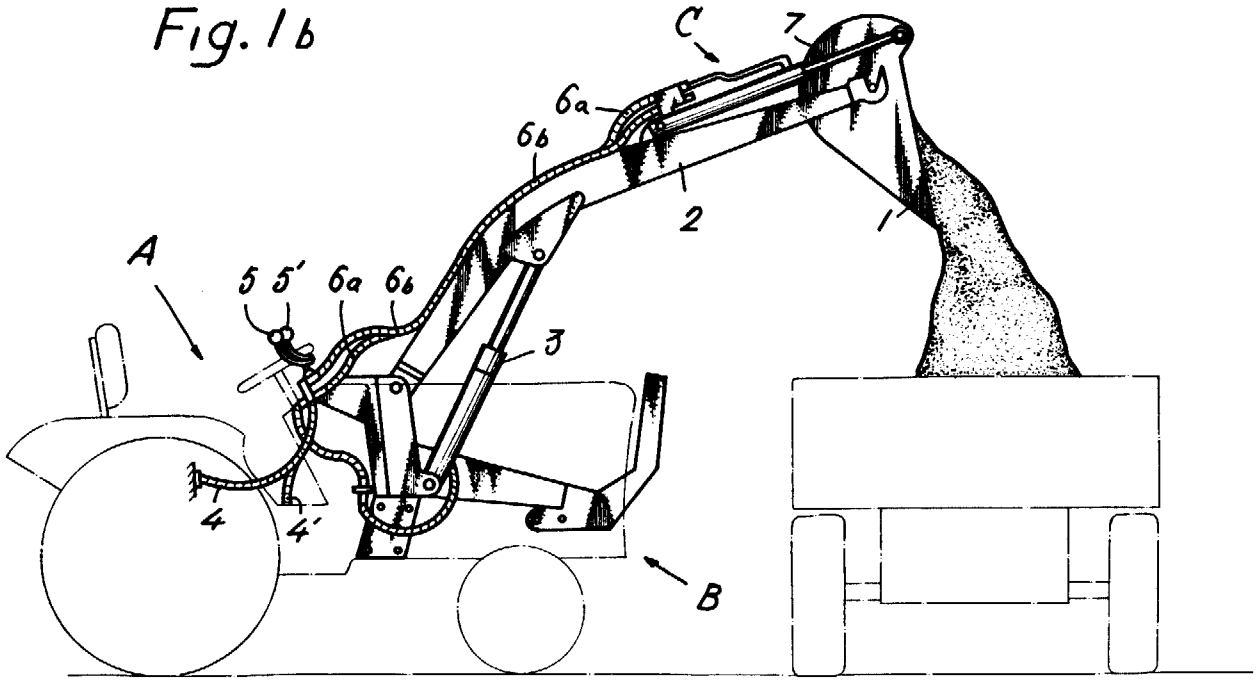
FIG. 1*b* is a side view of said tractor shown performing a loading operation.

The reciprocating hydraulic cylinder C operates to rotate a bucket 1 pivoted to the front end of a lift arm 2 so as to scoop earth, sand or other load and then discharge it. The lift arm 2 is raised and lowered by a hydraulic cylinder 3 during loading a truck or the like with earth, sand or other load (see FIG. 1*b*). The numeral 4 designates a high pressure hose connected to a hydraulic pump; 4', a high pressure hose connected to an oil tank; and 5, 5' designate control levers for switching the direction of flow of oil.

Designated at **6*a* is a high pressure hose through which oil is fed to the front chamber b of the hydraulic cylinder C to retract the piston rod 7 so as to rotate the bucket 1 in a counterclockwise direction as viewed in the figure when scooping earth, sand or other load. At this time, the return oil from the rear chamber b of the hydraulic cylinder C flows back into the oil tank through another high pressure hose 6*b*. When said load is to be discharged, oil is fed to the rear chamber b through the high pressure hose 6*b*, whereby the rod 7 is extended to rotate the bucket 1** clockwise. At his time, the return oil from the front chamber a flows into the rear chamber b as a result of the function of the device of the invention to be described below.

FIGS. **2*a*, 2*b* and 2*c* show a first embodiment of the invention. A speedup device is indicated at 10 and comprises a block member 11 and a poppet 14. The block member 11 has a round holelike chamber 12 for receiving the poppet 14, the upper end of said chamber 12 being closed with a plug 21 screwed thereinto. The lower portion of the chamber 12 terminates in a port P4 communicating with the rear chamber b of the reciprocating cylinder C. The upper portion of the block member 11 is formed with a port P1 which establishes communication between the high pressure hose 6*a* and the chamber 12. The lower portion of the block member 11 is formed with a port P2 which establishes communication between the high pressure hose 6*b* and the chamber 12. Further, between the ports P1 and P2, there is formed a port P3 which establishes communication between the front chamber a of the hydraulic cylinder C and the chamber 12 through a pipe 9**.

The poppet 14 has a stepped cylindrical contour with a projection 16 provided at one end thereof and is axially slidably fitted in the poppet receiving chamber 12 of the block member 11. The other end surface of the poppet 14 is formed with an axial hole 17 whose inner end terminates in a passage hole 18 which extends through the poppet 14 and opens to the peripheral surface of the latter. The poppet 14 is adapted to be axially moved in the poppet receiving chamber 12 of the block member 14 to function as a poppet valve.

More particularly, the arrangement of the ports of the block member is such that when the poppet 14 is lifted until its projection 16 abuts against the plug 21, the port P1 is closed by the peripheral surface 15 of the poppet 14 while the port P3 coincides with the passage hole 18 of the poppet 14 to communicate therewith and that when the poppet 14 is lowered until its lower end surface 29 abuts against a shoulder 13 formed on the lower end of the poppet receiving chamber 12, the ports P1 and P3 communicate with each other above the poppet 14.

The poppet 14 is normally held in its neutral position shown in FIG. **2*a* by springs 22 and 23** mounted on its upper and lower ends.

The speedup device-equipped reciprocating hydraulic cylinder constructed in the manner described above operates in the following manner.

FIG. **2*b* shows the flow condition of oil established when the bucket 1 is rotated counterclockwise to scoop earth, sand or other load. When the control lever 5 is operated to feed pressure oil from the oil pump through the high pressure hose 6*b*, pressure acts on the upper end surface 19 of the barrel of the poppet 14, whereby the poppet 14 is depressed until the lower end surface 20 abuts against the shoulder 13 of the chamber 12, with the pressure oil flowing through the port P3 and pipe 9 into the front chamber a of the hydraulic cylinder C. As a result, the piston 8 is moved under the hydraulic pressure to retract the piston rod 7. At this time, the return oil from the rear chamber b flows back into the oil tank through the high pressure hoses 6*b* and 4'. The rate of retraction of the piston rod 7** in the speedup device-equipped reciprocating hydraulic cylinder, in this case, is no different from that of a conventional reciprocating hydraulic cylinder.

Figure 2A:
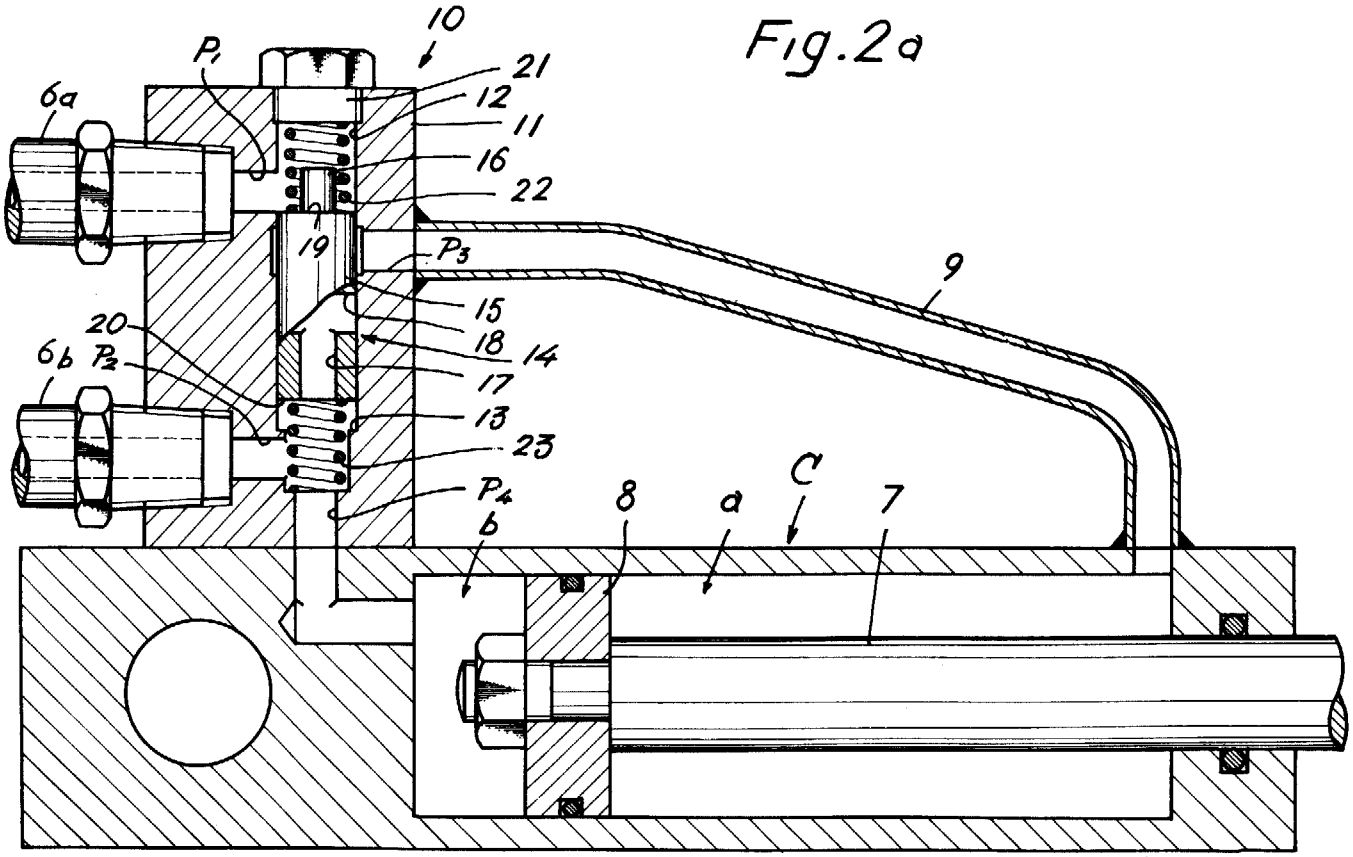
FIGS. 2*a* through 2*c* are side views, in longitudinal section, showing a reciprocating cylinder equipped with a speedup device according to an embodiment of the invention.
Figure 2B:
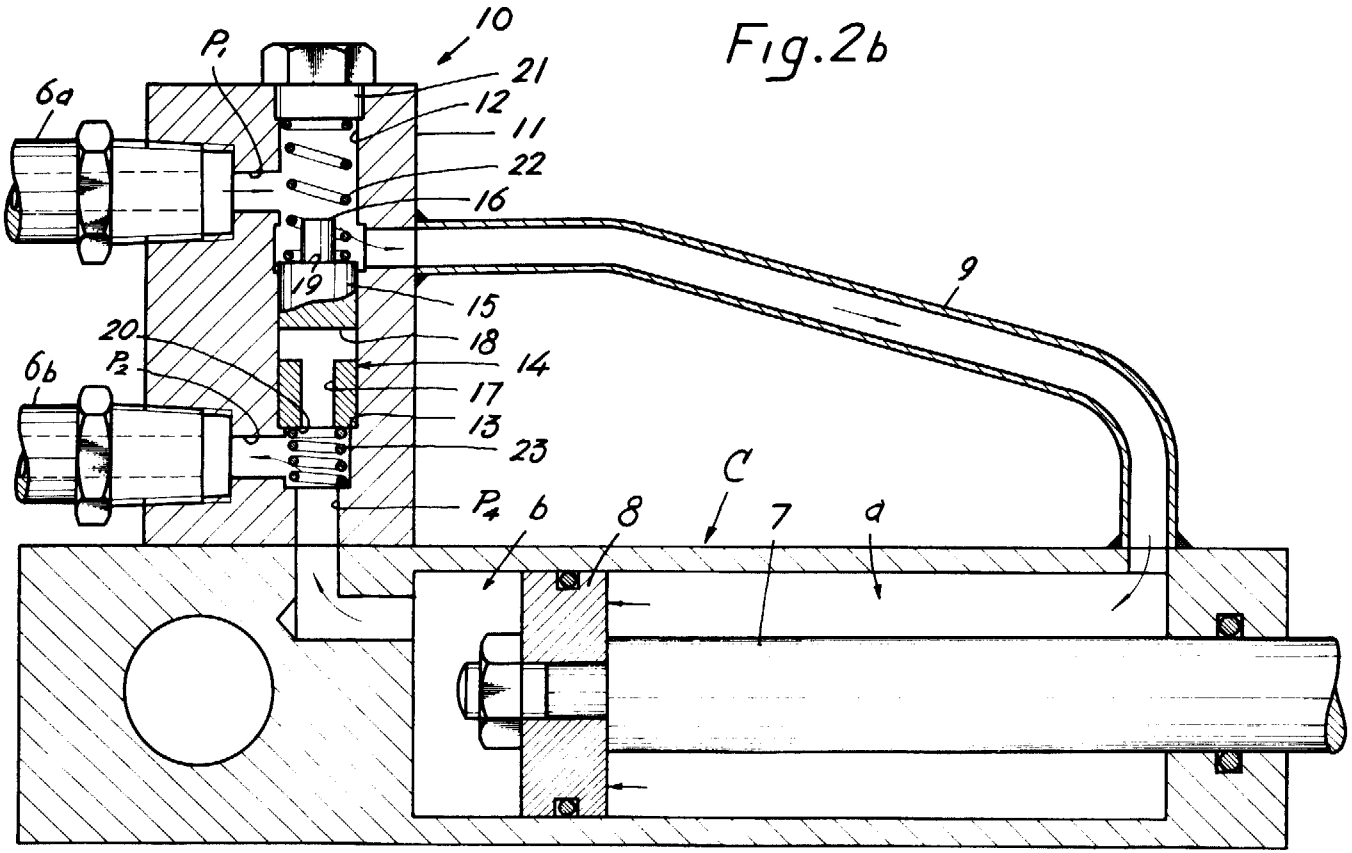
Figure 2C:
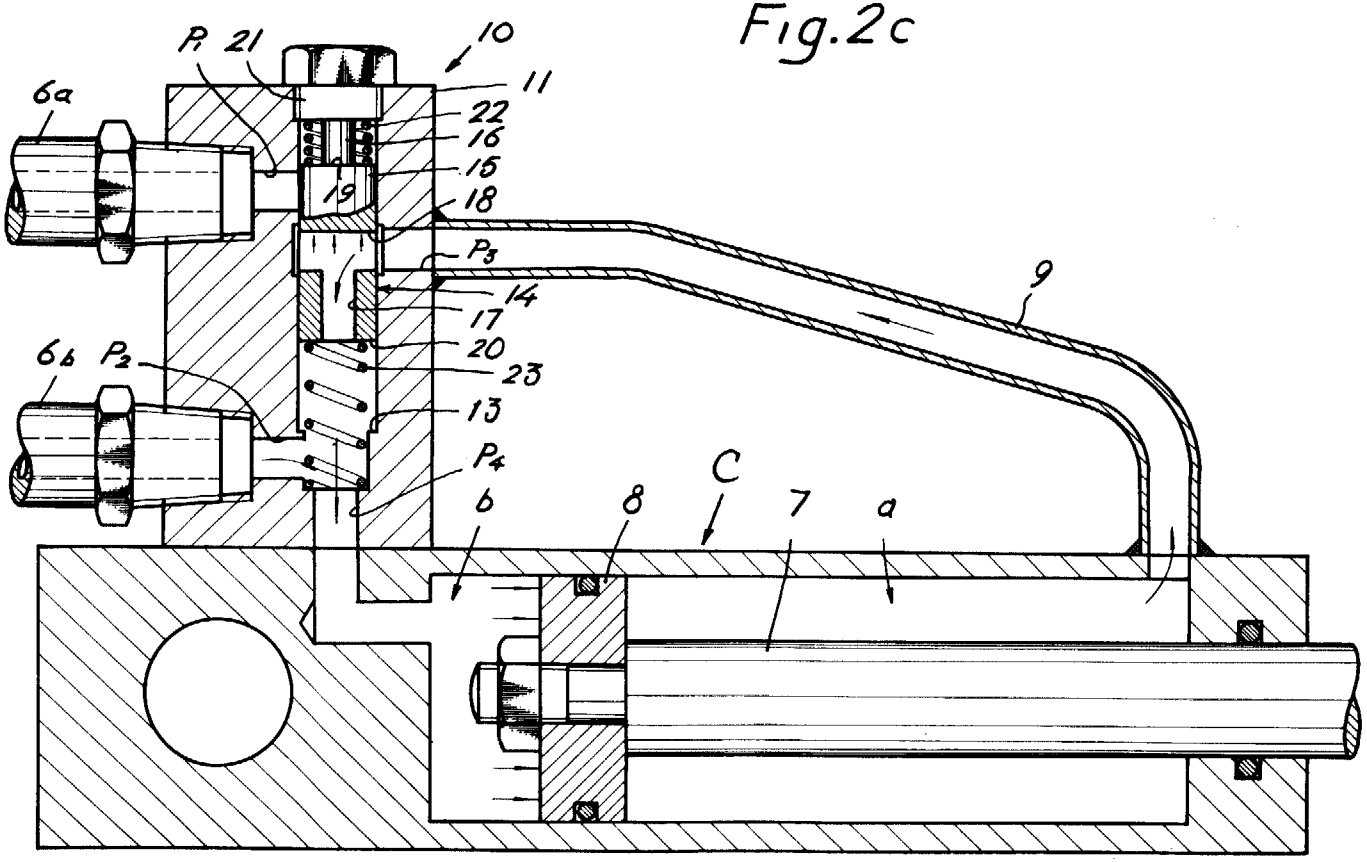

FIG. **2*c* shows the flow condition of oil in the speedup device-equipped reciprocating hydraulic cylinder when the bucket 1 is rotated clockwise to discharge said load. When the control lever 5' is operated from the neutral position (FIG. 2*a*) to feed pressure oil through the high pressure hose 6*b*, the oil flows into the rear chamber b through the port P4 to urge the piston 8. At this time, since the port P3 is closed by the peripheral surface 15 of the poppet 14, there is no place for the return oil from the front chamber to go to and hence high pressures are produced in the front and rear chambers a and b. However, concurrently therewith, the oil pressure also acts on the lower end surface 20 of the poppet 14, pushing up the latter until the end surface of its projection 16 abuts against the plug 21, with the result that communication is established between the port P3 and the passage hole 18 of the poppet 14, allowing all the return oil from the front chamber a to join the pressure oil from the hydraulic pump and flow therewith into the rear chamber b. Consequently, the rate of supply of oil to the rear chamber b is increased to increase the rate of extension of the piston rod 7. In other words, the discharge rotative speed of the bucket 1** is increased.

Figure 3:
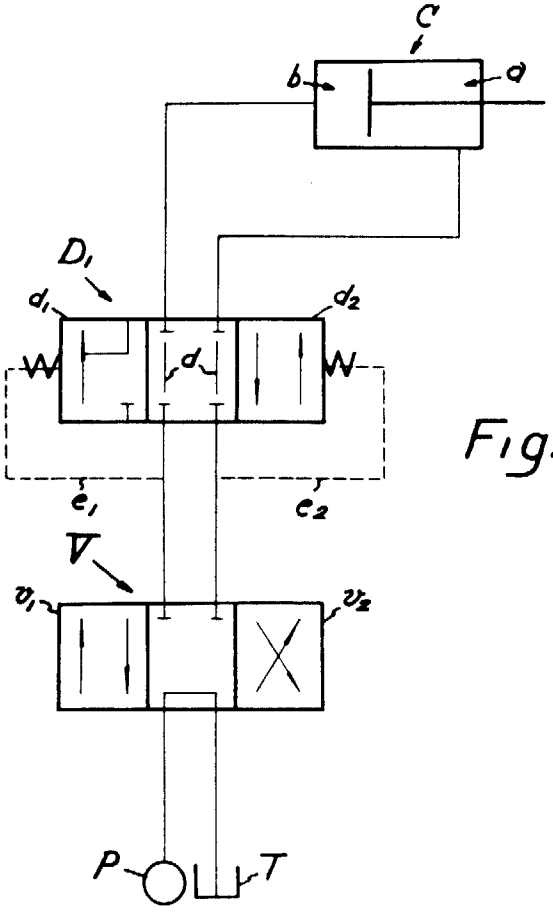
FIG. 3 is a basic circuit diagram for the system shown in FIGS. 2*a* through 2*c;*

FIG. 3 shows a basic circuit for the above device according to the first embodiment of the invention. Thus, the invention is not limited to the above described configurations and arrangement but it can be embodied in any form so long as it agrees with said basic circuit.

When the control lever 5 is operated to switch the control valve V to the side v1, the pressure oil from the pump P flows through the intermediate port d of the speedup device D1 into the rear chamber b of the cylinder C. As a result, the oil in a pilot circuit e1 is sufficiently increased to switch the speedup device D1 to the side d1. Thus, as the piston rod extends, all the oil in the front chamber a of the cylinder C joins the pressure oil from the pump P within the speedup device D1 and is forced therewith into the rear chamber b of the cylinder C. As a result, the rate of extension of the piston rod is increased.

Further, when the control lever 5' is operated to switch the control valve V to the side v2, the speedup device D1 is switched to the side d2 owing to a rise in the pressure in a pilot circuit e2, so that the pressure oil from the pump P is fed to the front chamber a of the cylinder C, with the oil in the rear chamber b flowing back into the tank T through the control valve V. As a result, the piston rod is retracted at substantially the same rate as in a conventional reciprocating cylinder.

Figure 4A:
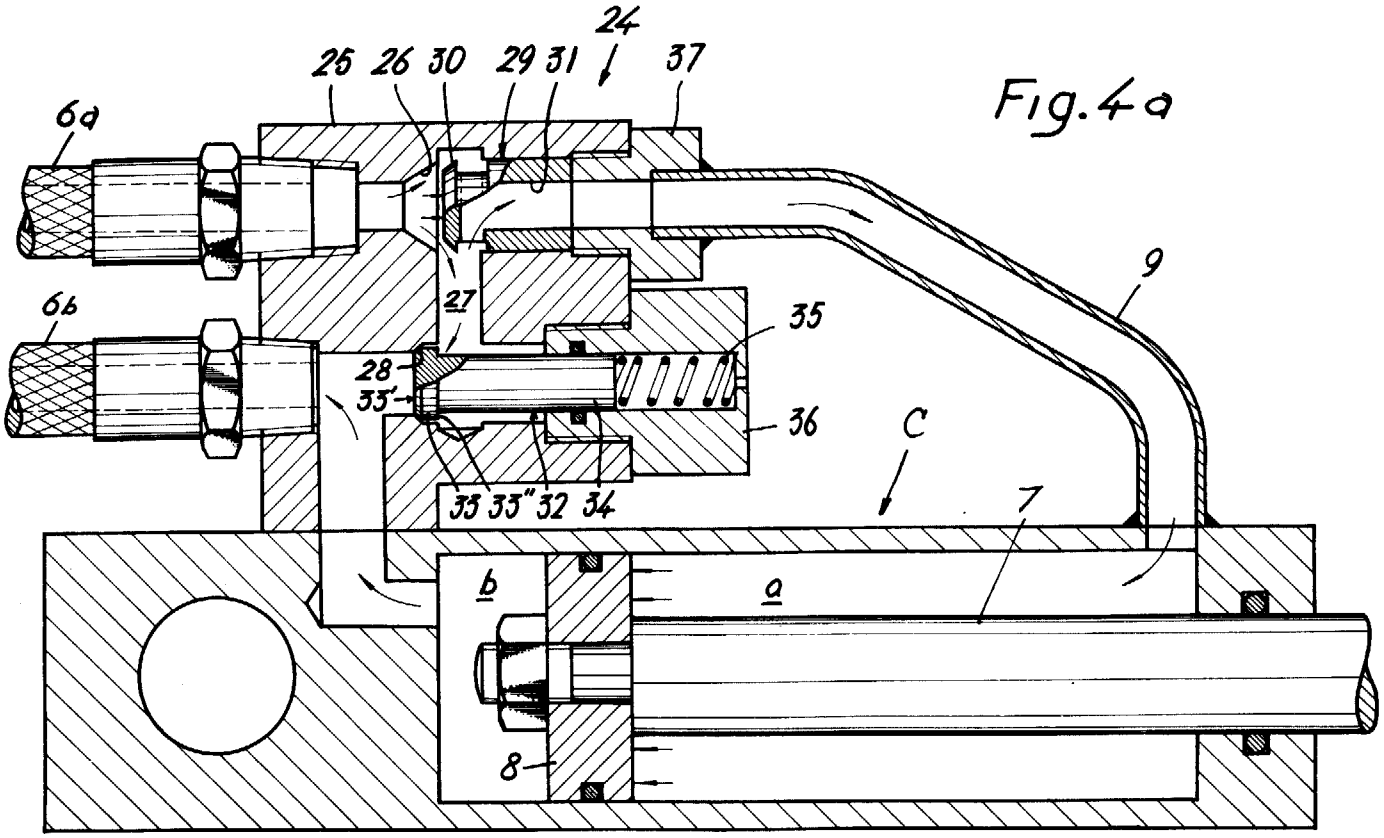
FIGS. 4*a* and 4*b* are side views, in longitudinal section, showing a reciprocating cylinder equipped with a speedup device according to another embodiment of the invention.

FIG. 4*a* shows a second embodiment of the present invention. In this figure, a speedup device is indicated at 24 and comprises a block member 25 and two poppets 29 and 32 slidably received in said block member 25.

The poppet 29 performs the function of a valve between a valve head 30 formed on the end thereof adjacent the high pressure hose 6*a* and a valve seat 26 formed on the block member 25. The other end surface facing a pipe 9 communicating with the front chamber a of a hydraulic cylinder C is formed with an axially extending hollow portion 31 which extends through the poppet 29 and whose peripheral surface opens to the intermediate chamber 27 of the block member 25.

The other poppet 32 has a stepped cylindrical contour with a valve head portion 33 of increased diameter formed on the end thereof adjacent the high pressure hose 6*b* and a valve stem portion 34 and performs the function of a valve between the valve head 33 and a valve seat 28 formed on the block member 25. The poppet 32 is normally maintained in its valve closing position by a spring 35. The poppet 32 and spring 35 are fitted in a cap knob 36 which is screwed into the block member 25.

The reciprocating hydraulic cylinder equipped with the speedup device constructed in the manner described above operates in the following manner.

FIG. 4*a* shows the flow condition of oil established when the bucket 1 is rotated counterclockwise to scoop earth, sand or other load. When the control lever 5 is operated to feed pressure oil from the hydraulic pump through the high pressure hose 6*a*, hydraulic pressure acts on the valve head 30 of the poppet 29 to move the poppet 29 until the opposite end surface 31 abuts against a pipe joint 37. Therefore, the pressure oil flows into the intermediate chamber 27 of the block member 25. At this time, since communication between the intermediate chamber 27 and the rear chamber b of the hydraulic cylinder C is cut off by the poppet 32, the pressure oil flows into the hollow portion 31 of the poppet 29 through its periphery and then into the front chamber a of the hydraulic cylinder C through the pipe 9. As a result, the piston 8 is urged to retract the piston rod 7, thereby rotating the bucket 1 counterclockwise to scoop earth, sand or other load. In this case, since the return oil from the rear chamber b is prevented from flowing into the intermediate chamber 27 by the poppet 32, it flows back into the oil tank through the high pressure hoses 6*b* and 4'. In other words, the operation of the speedup device-equipped reciprocating hydraulic cylinder, in this case, is no different from that of ordinary hydraulic cylinders.

Figure 4B:
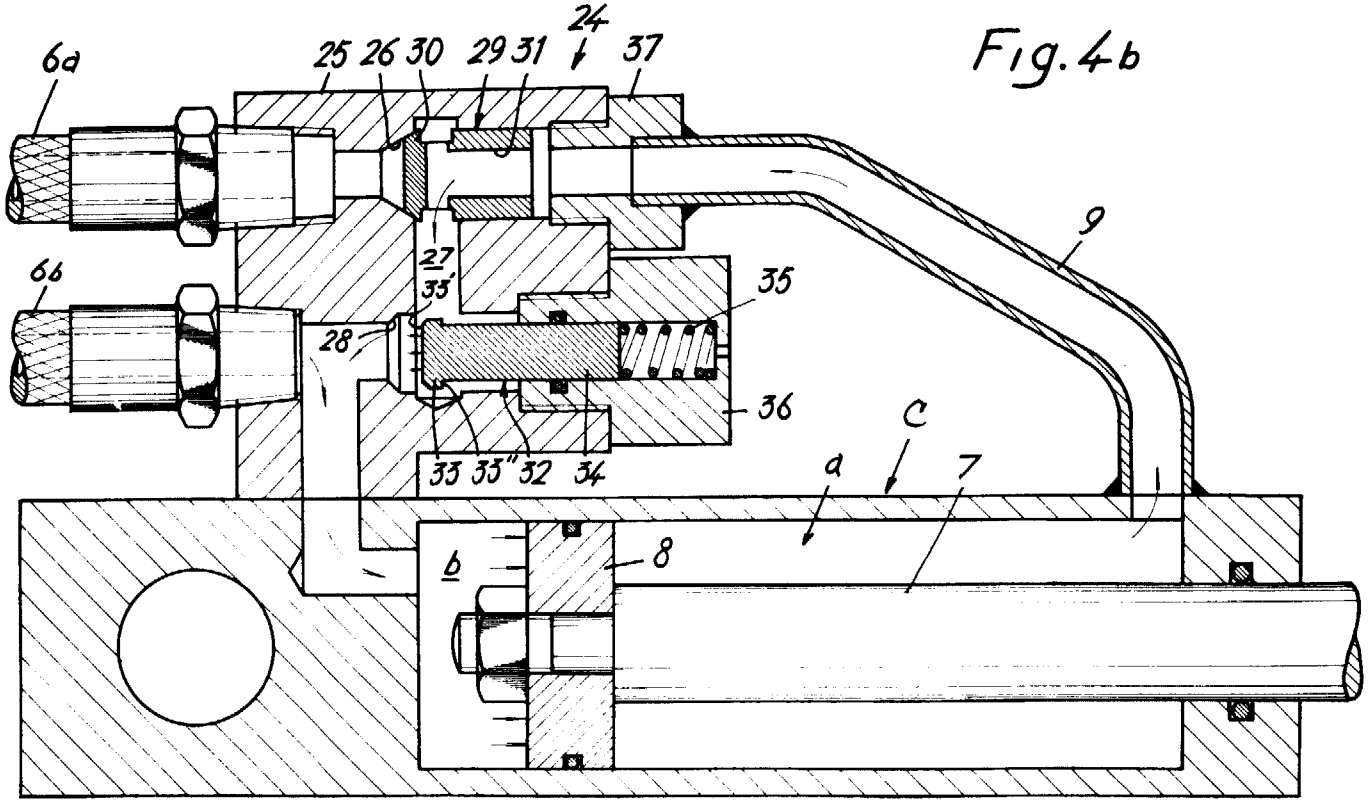

FIG. 4*b* shows the flow condition of oil in the speedup device-equipped reciprocating hydraulic cylinder established when earth, sand or other load is to be discharged. When the control lever 5' is operated to feed pressure oil through the high pressure hose 6*b*, it flows into the rear chamber b of the hydraulic cylinder C to urge the piston 8. When the piston 8 is moved to a certain extent, the return oil from the front chamber a exerts a hydraulic pressure on the poppet 29 to slide the latter toward the high pressure hose 6*a*. As a result, communication between the high pressure hose 6*a* and the intermediate chamber 27 of the block member 25 is cut off. Further, the poppet 32 cuts off communication between the intermediate chamber 27 and the rear chamber b. Consequently, high pressures are produced in the front and rear chambers a and b. However, hydraulic pressure is acting on the end surface 33' of the valve head 33 of the poppet 32 and, moreover, as can be seen in the figure, since the area of the end surface 33' of the valve head 33 is larger than the area of the back surface 33" of the valve head 33, the poppet 32 is slid against the resilient force of the spring 35 to establish communication between the intermediate chamber 27 and the rear chamber b. When the thrusts acting on the opposite sides of the piston 8 exerted by the pressures in the front and rear chambers a and b at this point of time are compared with each other, it is seen that since the area of the side of the piston 8 facing the front chamber a is smaller than the area of the side of the piston 8 facing the rear chamber b by an amount corresponding to the cross-sectional area of the piston rod 7, the thrust on said side facing the rear chamber b is greater, so that the piston rod 7 is forwardly thrusted out.

This relation is expressed by the following equation.

Cylinder thrust = pressure difference across piston × effective area of piston.

Thus, the oil in the front chamber a flows into the rear chamber b and the rate of flow of oil into the rear chamber b is increased on account of the return oil from the front chamber a joining the pressure oil from the oil pump. As a result, the rate of extension of the piston rod of the hydraulic cylinder C becomes greater than in conventional reciprocating hydraulic cylinders.

Figure 5:
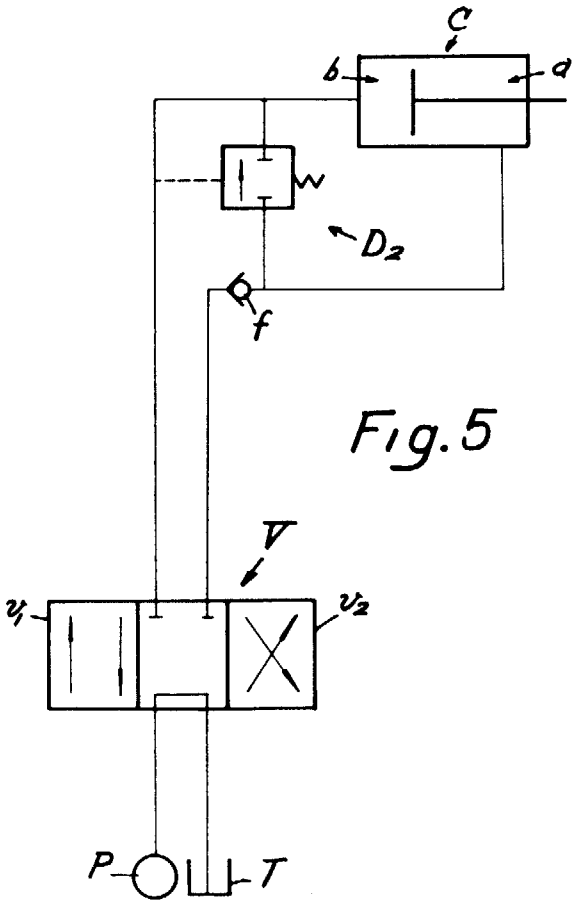
FIG. 5 is basic circuit diagram for the system shown in FIGS. 4*a* through 4*b;*

FIG. 5 shows a basic circuit for the above described second embodiment. Thus, the invention is not limited to the above described arrangement but it can be embodied in any form so long as it agrees with said basic circuit.

When the control valve V is switched to the side v1, the pressure oil from the pump P flows into the rear chamber b of the cylinder C and at the same time hydraulic pressure acts on the speedup device D2 to operate the latter, whereby all the oil in the front chamber a flows into the rear chamber b via the speedup device D2. As a result, the rate of extension of the piston rod is increased. In addition, f designates a check valve.

When the control valve V is switched to the side v2, the pressure oil from the pump P flows through the check valve f into the front chamber a of the cylinder C while all the oil in the rear chamber b flows through the control valve V back into the tank T.

Figure 6:
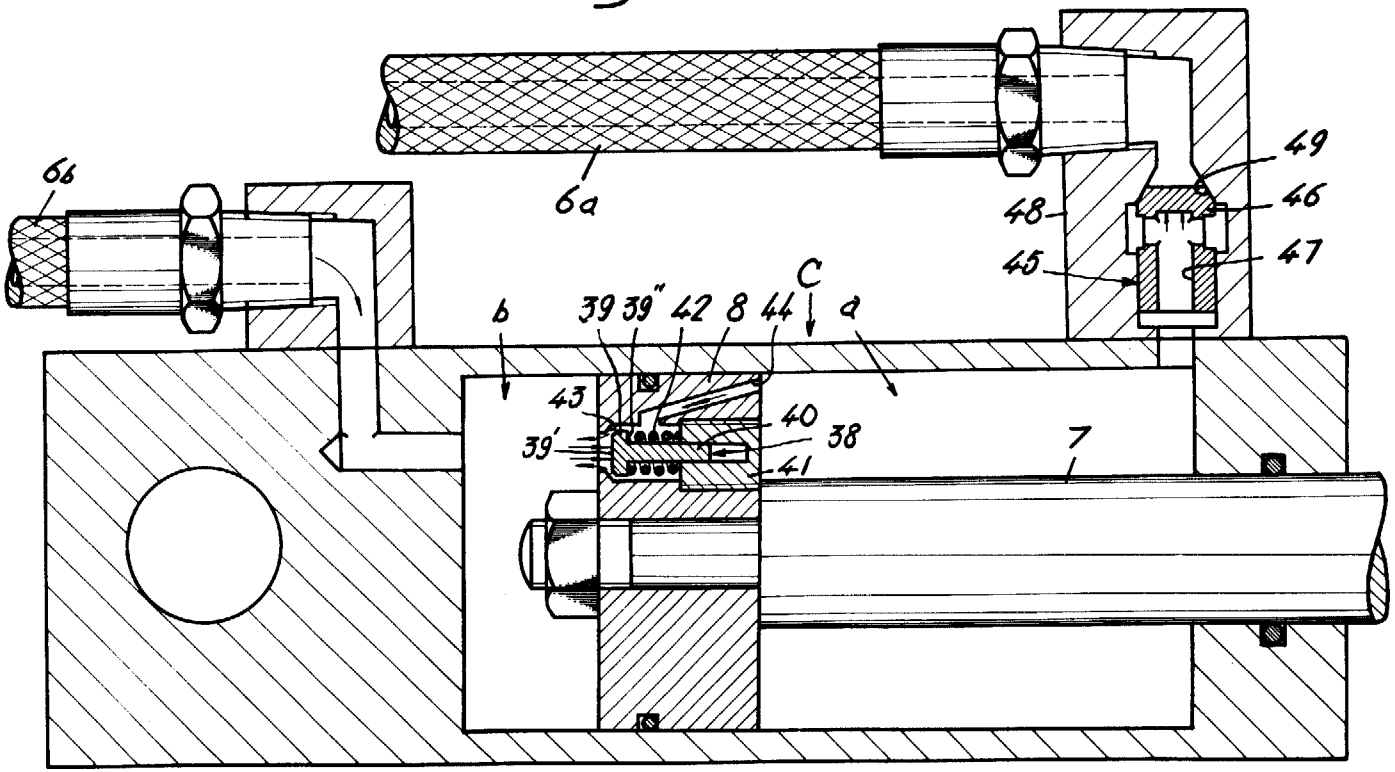
FIG. 6 is a side view, in longitudinal section, showing a reciprocating cylinder equipped with a speedup device according to a further embodiment of the invention.

FIG. 6 shows a third embodiment of the invention. A poppet 38 consists of a valve head 39 and a valve stem 40 and is installed in a piston 8 with the help of a cap knob 41. The valve stem 41 is slidably fitted in the knob 41, and a spring 42 is disposed between the valve head 39 and the cap knob 41, whereby the poppet 38 normally closes a communication hole 44 between the front and rear chambers a and b of a cylinder C by its valve head 39 cooperating with a valve seat 43. Designated at 45 is another poppet disposed between the front chamber a and the pressure hose 6*a* and having a valve head 46 cooperating with a valve seat 49 formed on a block member 48 to prevent the oil in the front chamber a from flowing into the high pressure hose 6*a* when the piston rod 7 extends. The poppet 45 has a hollow portion 47 which opens at the peripheral surface of the poppet 45 and communicates with the front chamber a in order to admit the pressure oil from the high pressure hose into the front chamber a. The poppet 45 is capable of sliding axially under hydraulic pressure.

Because of the arrangement described above, when pressure oil is fed to the high pressure hose 6a, hydraulic pressure acts on the top surface of the valve head 46 to depress the poppet 45 with the valve head leaving the valve seat, admitting the pressure oil into the front chamber a. The pressure oil entering the front chamber a tries to pass through the communication hole 44, but since the latter is closed by the poppet 38, eventually the piston 8 is moved. The oil in the rear chamber b is returned to the oil tank through the high pressure hoses 6b and 4'. The rate of movement of the piston is no different from that in the prior art.

On the other hand, when pressure oil is fed through the high pressure hose 6b, hydraulic pressure acts on the piston 8. Then, the return oil from the front chamber a pushes up the poppet 45, whereby communication between the front chamber a and the high pressure hose 6a is cut off, producing high pressures in the front and rear chambers a and b. Concurrently therewith, the valve head 39 of the poppet 38 is subjected to said pressures from both sides, i.e., the front and rear chambers a and b. However, since the area of the end surface 39' of the valve head is larger than that of its back surface 39'', the thrust from the rear chamber b is stronger, so that the poppet 38 is moved against the resilient force of the spring 42, establishing communication between the front and rear chambers a and b. As a result, the oil in the front chamber a flows into the rear chamber b through the communication hole 44, so that the rate of flow of oil into the rear chamber b is increased to increase the rate of movement of the piston 8.

Figure 7A:
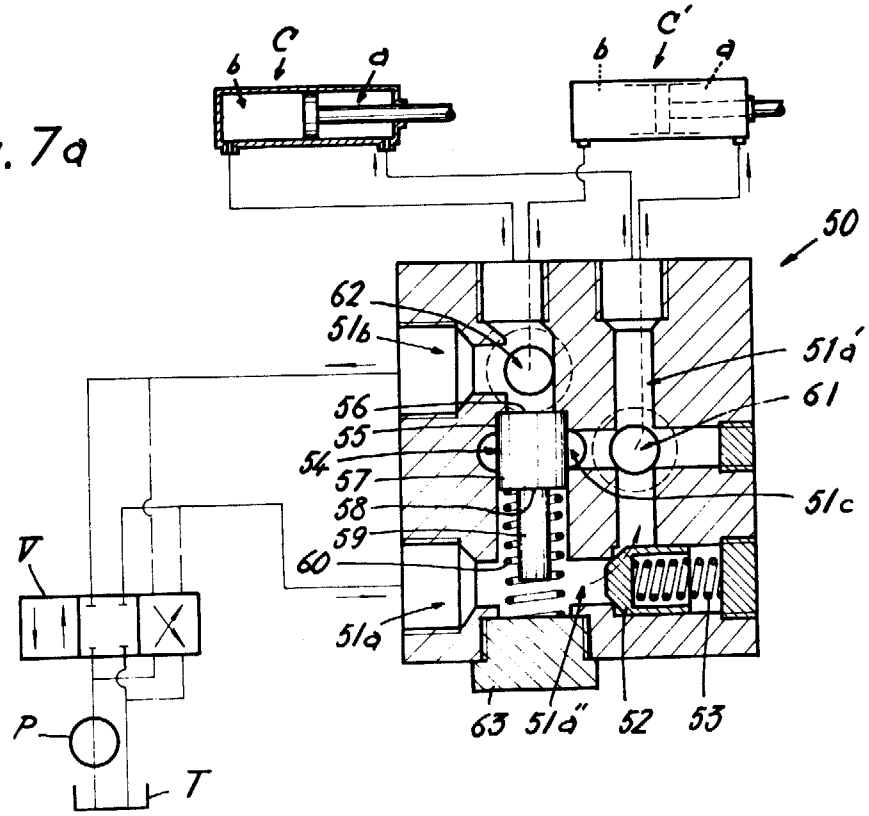
FIGS. 7*a* and 7*b* are explanatory views of reciprocating cylinders equipped with a speedup device according to another embodiment of the invention.

FIG. 7a shows a fourth embodiment of the invention. In this figure, P designates a pump; T, an oil tank; V, a control valve; C and C' designate reciprocating cylinders. A speedup device is indicated at 50 and is installed between the control valve V and the reciprocating cylinders C, C'. While two reciprocating cylinders are shown, only one reciprocating cylinder C will be described for convenience.

The speedup device 50 has an oil transport passageway 51a connecting the front chamber a of the reciprocating cylinder C and the control valve V, an oil transport passageway 51b connecting the rear chamber b and the control valve V, and an intermediate oil transport passageway 51c connecting said two oil transport passageways 51a and 51b. In addition, 61 designates a connection hole for connecting the front chamber a of the other reciprocating cylinder C' and the oil transport passageway 51a, and 62 designates a connection hole for connecting the rear chamber b of the other reciprocating cylinder C' and the oil transport passageway 51b, said connection holes extending to the back of the drawing sheet.

A check valve 52 is provided substantially in the middle of the oil transport passageway 51a, said check valve being axially urged by a spring 53 so that it normally closes the transport passageway 51a to prevent the return flow of oil from the front chamber and that it will be opened by the pressure of oil fed from the control valve V to the oil transport passageway 51a. The intermediate oil transport passageway 51c has a stepped cylindrical or piston-shaped circulation valve 54 disposed with the end surface 56 of its valve head 55 of large diameter facing the oil transport passageway 51b and its peripheral surface 57 facing an oil transport passageway 51a' on the outlet side, said circulation valve being axially urged by a spring 60 disposed between the back surface 58 of the valve head 55 and a plug 63 so as to normally close the oil transport passageway 51c. The opening of the circulation valve 54 is effected by the pressure of oil fed from the control valve V to the oil transport passageway 51b.

The operation of the above described arrangement is as follows.

When it is desired to feed pressure oil to the front chamber a of the reciprocating cylinder C to retract the piston rod 7 (for example, for scooping earth, sand or other load), the control valve V is operated to feed the pressure oil from the hydraulic pump P to the oil transport passageway 51a. (Refer to the chain lines in FIG. 7a.) Then, the check valve 52, which has been closed up to now, is urged by the hydraulic pressure to be axially moved for opening against the resilient force of the spring 53, thus admitting the pressure oil into the front chamber a via the oil transport passageway 51a so as to push back the piston 8. At this time, the pressure oil fed to the oil transport passageway 51a also acts on the back surface 58 of the valve head 55 of the circulation valve 54 to tightly close the latter as assisted by the resilient force of the spring 60. Therefore, the return oil being forced out of the rear chamber b as the piston 8 returns is positively returned to the oil tank T via the oil transport passageway 51b and the control valve V. The rate of movement of the piston rod 7 in the hydraulic cylinder C, in this case, is no different from that of ordinary hydraulic cylinders, and there is no need to make it differ therefrom.

Figure 7B:
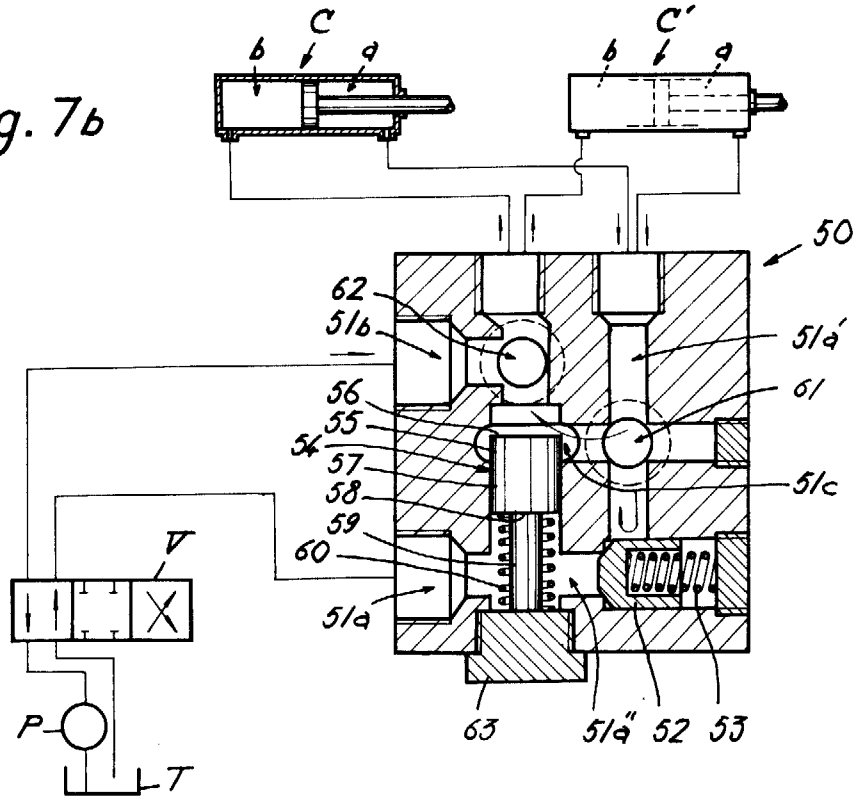

Next, a case where the piston rod 7 is to be extended (a case where earth, sand or other load is to be discharged) will now be described with reference to FIG. 7b.

When the control valve V is switched to feed the pressure oil from the hydraulic pump P to the oil transport passageway 51b, since the check valve 52 is maintained closed by the spring 53 and the circulation valve 54 is also maintained closed by the spring 60, the oil fed to the oil transport passageway 51b flows into the rear chamber b of the cylinder C. At this time, since there is no place for the oil in the front chamber a to go to, the hydraulic pressures in the front and rear chambers a and b are greatly increased while the piston 8 is only slightly moved. The hydraulic pressures act on the circulation valve 54. More particularly, the hydraulic pressure in the rear chamber b acts on the end surface 56 of the valve head 55 of the circulation valve 54 while the hydraulic pressure in the front chamber a acts on the peripheral surface 57 of the circulation valve 54. However, since the hydraulic pressure applied to the peripheral surface 57 is counteracted and does not affect the valve movement at all, eventually the circulation valve 54 is downwardly moved by the thrust applied to the end surface 56 against the resilient force of the spring 60 until the valve stem abuts against the plug 63. Thereby, the intermediate oil transport passageway 51c is opened to establish communication between the front and rear chambers a and b.

When the pressures to which the piston 8 is subjected with the circulation valve 54 opened are considered, it is seen that since the area of the side of the piston 8 facing the front chamber a is smaller than the area of the opposite side of the piston 8 facing the rear chamber b by an amount corresponding to the cross-sectional area of the piston rod 7, the thrust on the side facing the rear chamber b is greater than the thrust on the side facing the front chamber a. Therefore, the piston 8 is moved in a direction which extends the piston rod 7 on the following principle.

Cylinder thrust = pressure difference across piston × effective area of piston.

Concurrently therewith, the oil in the front chamber a enters the intermediate oil transport passageway 51c and flows into the rear chamber b. As a result, the rate of flow of oil into the rear chamber b is increased by an amount corresponding to the return flow of oil from the front chamber a and hence the rate of extension of the piston rod 7 is correspondingly increased.

If it is desired to make the rate of extension of the piston rod 7 equal to the rate of retraction thereof, this can be achieved by selecting the diameter of the piston rod 7 so that the cross-sectional area of the front chamber a is about half that of the rear chamber b. That is, if all the return oil from the front chamber a is allowed to flow into the rear chamber b, the rate of flow of oil into the rear chamber b will be twice the rate of flow of oil into the front chamber a. Consequently, the rate of extension of the piston rod 7 becomes equal to the rate of retraction thereof.

It is clear that the operation of the other reciprocating cylinder C' is the same as in the reciprocating cylinder C described above. Further, it is also easily possible to connect additional reciprocating cylinders to the above described speedup device 50.

The speedup device of the present invention is installed in the hydraulic circuit of a reciprocating cylinder substantially between a control valve and the cylinder and may be integral with or separate from the cylinder.

Though ommited in the above description, sealing means, such as well-known O-rings, are provided in slide portions where leakage of fluid should be prevented, for example, between the piston and cylinder.

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

I claim:

1. In a machine utilizing a fluid actuated reciprocating piston/cylinder mechanism, a power transmitting rod connected to one side of the piston to define a retraction chamber and the side of the piston opposite the power transmitting rod defining an extension chamber, the volume of the retraction chamber being less than the volume of the extension chamber; a directional control valve for alternately fluidly connecting a source of pressurized fluid and a reservoir with a pair of control valve outlets adapted for controlling alternate extension and retraction of the power transmitting rod; wherein the improvement comprises a two valve speed-up valve unit comprising:

a speed-up valve housing;

an extension chamber valve inlet in fluid communication with one of said control valve outlets;

a retraction chamber valve inlet in fluid communication with the other of said control valve outlets;

an extension chamber valve outlet in fluid communication with the piston/cylinder extension chamber;

a retraction chamber valve outlet in fluid communication with the piston/cylinder retraction chamber;

a first fluid passage interconnecting said retraction chamber valve inlet and said retraction chamber valve outlet;

a check valve interposed in said first fluid passage and having a first position wherein fluid flow through said first fluid passage is completely blocked and a second position wherein fluid flow is permitted, said check valve being actuated by fluid pressure in said first fluid passage;

check valve biasing means for normally biasing said check valve to said first fluid blocking position;

a second fluid passage interconnecting said extension chamber valve inlet and said extension chamber valve outlet;

a circulation valve means comprising a single unitary piston element, said piston element comprising a solid cylindrical plug having opposed faces with a centrally located valve stem extending from one of said faces for engaging said housing when said circulation valve means is open, said plug being slidable in a bore opening directly into said first passage upstream of said check valve, said circulation valve means being positioned in a third fluid passage comprising a first portion extending between said piston element and said retraction chamber valve outlet and a second portion element extending between said piston element and said extension chamber valve outlet, said first portion joining with said piston element along a longitudinal side of said piston element, and said second portion joining with said piston element along the other face of said piston element, whereby only fluid pressure in said second portion of said third passage can actuate said circulation valve to an open position wherein said first and second portions of said third passage are joined, said circulation valve being normally biased to a closed position by a single circulation valve biasing means interposed between said housing and said one face and surrounding said valve stem wherein fluid flow in said third fluid passage between said first and second portions is blocked;

wherein when said power transmitting rod is retracted, said control valve is actuated to fluidly connect said pump with said first fluid passage and to connect said reservoir with said second fluid passage, said pressurized fluid in said first fluid passage acting on said check valve to cause said check valve to assume said second position, whereby fluid flows to said piston/cylinder retraction chamber and, as said power transmitting rod retracts, fluid flows from said extension chamber through said second passage and control valve to said reservoir, said circulation valve assuming said closed fluid blocking position under the force of said circulation valve biasing means and fluid acting on said one face; and wherein when said power transmitting rod is extended, said control valve is actuated to fluidly connect said pump with said second fluid passage, said pressurized fluid in said second fluid passage acting on said circulation valve means to cause said circulation valve means to assume said open position whereby fluid flow in said third fluid passage between said retraction chamber valve outlet and said extension chamber valve outlet is permitted, said check valve assuming said first position under the force of said check valve biasing means, whereby fluid flows from said pump to said piston/cylinder extension chamber and, as said power transmitting rod extends, fluid flows from said retraction chamber through said third fluid passage to said piston/cylinder extension chamber, whereby an increased volume flow rate of fluid flows to said extension chamber during power rod extension to compensate for the increased volume of said extension chamber.

* * * * *